United States Patent [19]

Keebler

[11] 4,027,710

[45] June 7, 1977

[54] CONVERTIBLE HANDBAG

[76] Inventor: EveLynne Marie Keebler, 11 Poplar Ave., Merchantville, N.J. 08109

[22] Filed: July 15, 1976

[21] Appl. No.: 705,527

[52] U.S. Cl. ..... 150/28 A; 150/33
[51] Int. Cl.[2] ..... A45C 3/06
[58] Field of Search ..... 150/28 R, 28 A

[56] References Cited

UNITED STATES PATENTS

| | | | |
|---|---|---|---|
| 1,597,339 | 8/1926 | Berkowitz | 150/28 A |
| 2,798,524 | 7/1957 | Ryon | 150/28 A |
| 2,809,685 | 10/1957 | Lowy | 150/28 A |
| 3,182,701 | 5/1965 | Ginsburg | 150/28 A |

*Primary Examiner*—Donald F. Norton
*Attorney, Agent, or Firm*—Duffield & Lehrer

[57] ABSTRACT

One end of a plurality of facing members are secured to the bottom of a handbag. Each of said facing members is moveable so as to cover one side wall or the other of the handbag. The facing members and the side walls of the handbag being colored in such a manner that each time a facing member is moved from one side wall to the other, the color of the sides of the handbag changes. A clasp is provided on each side wall for maintaining the facing members in place and vertically extending metal channel members located along each side edge of the handbag cover the side edges of the facing members.

5 Claims, 3 Drawing Figures

CONVERTIBLE HANDBAG

This invention is directed toward a convertible handbag and more particularly toward a convertible handbag which includes a plurality of differently colored facing members which allows one to easily and quickly change the color of the handbag.

As is well known, most women consider their handbags as a necessary matching part of their dress. And they usually have many different handbags to match different clothing outfits. As a result, women are forced to spend a great deal of money purchasing many different handbags.

Attempts have been made in the past to create a convertible handbag, the color of which could be easily changed. Typical examples of these prior art handbags are shown in U.S. Pat. Nos. 2,809,685 and 3,182,701. These prior patents describe a device having a basic bag section and a plurality of interchangeable covers for the bag. The difficulties with these bags should be readily apparent. One must not only buy the basic bag but they must also purchase a plurality of the separate cover members. In addition, the bag can only accommodate one cover member at a time. This means that the additional cover members must be left at home and thus, the color of the handbag can only be changed when a women carrying the bag returns home and obtains another cover.

Another attempt to make a convertible bag is shown in U.S. Pat. No. 2,798,524. This patent describes a device having a bag section and a cover flap which has one end affixed to the bottom of the bag and which completely wraps around both sides and the top of the bag. The cover flap has a different color on each side so that the color of the bag can be changed by wrapping the cover flap around the bag either in the clockwise or counterclockwise direction. While this device has overcome some of the deficiencies of the patents described above, it also has several drawbacks. Most significantly, it can be seen that with the device of this patent it is only possible to convert the handbag between two different colors and that if additional colors are required it is necessary to remove and replace the cover flap.

The present invention overcomes the above described deficiencies of the prior art devices and provides a handbag which can be converted into a plurality of different colors. This is accomplished by having one end of a plurality of facing members secured to the bottom of a handbag such that each of the facing members is moveable so as to cover one side wall or the other of the handbag. The facing members and the side walls of the handbag are colored in various colors and arranged such that each time a facing member is moved from one side wall to the other, the color of the sides of the handbag changes. A clasp is provided on each side wall for maintaining the facing members in place and vertically extending channel members along each side edge of the handbag cover the side edges of the facing members.

For the purpose of illustrating the invention, there is shown in the accompanying drawing one form of the invention which is presently preferred; it being understood that the invention is not limited to the precise arrangements and instrumentalities shown.

Figure 1:
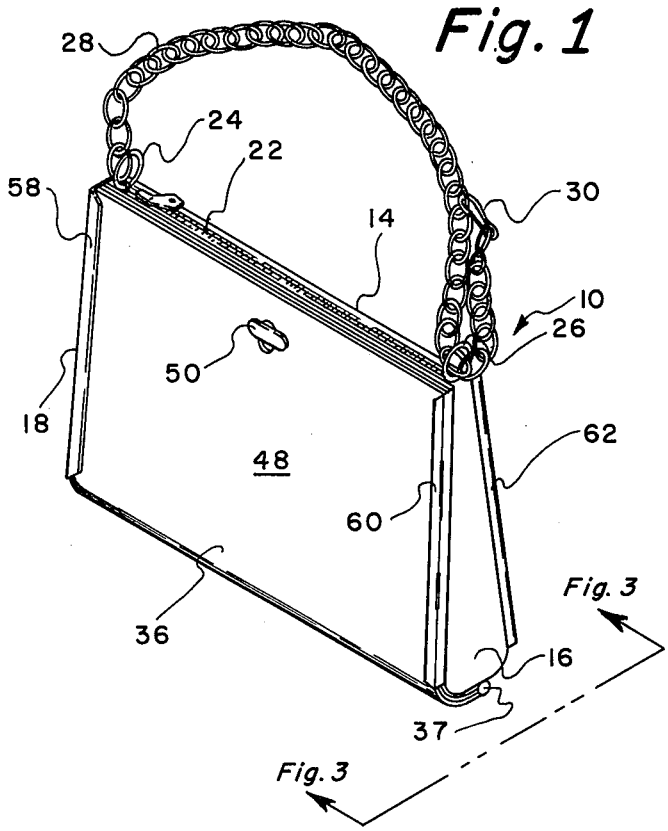
FIG. 1 is a perspective view of a handbag constructed in accordance with the principles of the present invention.

Referring now to the drawing in detail wherein like numerals designate like elements throughout the various figures, there is shown in FIG. 1 a handbag constructed in accordance with the principles of the present invention and designated generally at 10. Handbag 10 includes a basic bag section of substantially conventional construction and includes a first substantially vertically extending side wall 12 and a second substantially vertically extending side wall 14. First and second substantially vertically extending end walls 16 and 18 extend between the two side walls and bottom wall 20 extends between the side wall 12 and 14 and the end walls 16 and 18.

Connected to the top ends of the first and second side walls 12 and 14 is a zipper 22 which is used to open and close the bag 10. It should be readily apparent, however, that various other types of closure or fastening means could be substituted for the zipper 22. Handbag 10 is also provided with a handle which is comprised of a pair of rings 24 and 26 secured to the tops of the end walls 16 and 18. One end of chain 28 is secured to ring 24 and the other end extends through ring 26 and terminates in a spring clip 30. Spring clip 30 can be attached to any of the links of the chain 28, to the ring 24 or to the ring 26 so that the resulting length of the handle can be adjusted. Thus, the handbag 10 can be readily converted to a shoulder bag.

Figure 3:
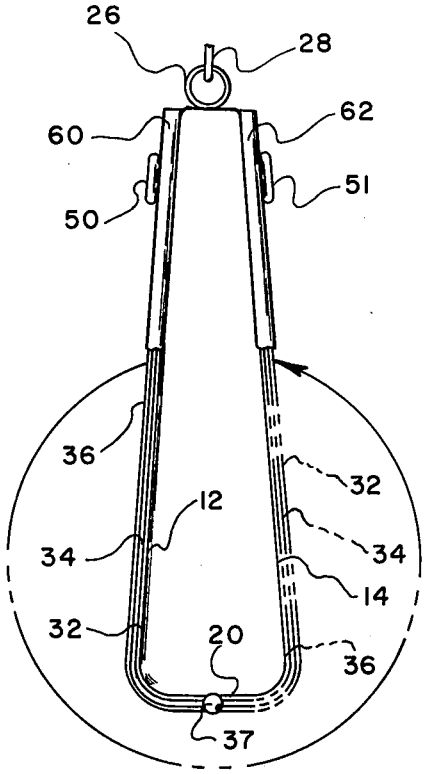
FIG. 3 is an end view of the device shown in FIG. 1 taken along the line 3—3 of FIG. 1.

In order that the color of the handbag can be quickly and easily changed, the handbag is provided with a plurality of facing members such as 32, 34 and 36. The bottom ends of each of the facing members 32, 34 and 36 are secured to a hinge member 37. Hinge 37 allows one, two or all three of the facing members 32, 34 and 36 to move between a first position wherein the facing members cover the first side wall 12 and a second position wherein the facing members cover the second side wall 14. This is perhaps shown best in FIGS. 2 and 3. The facing members 32, 34 and 36 are preferably made of a plastic or leather material covering a thin durable cardboard.

Figure 2:
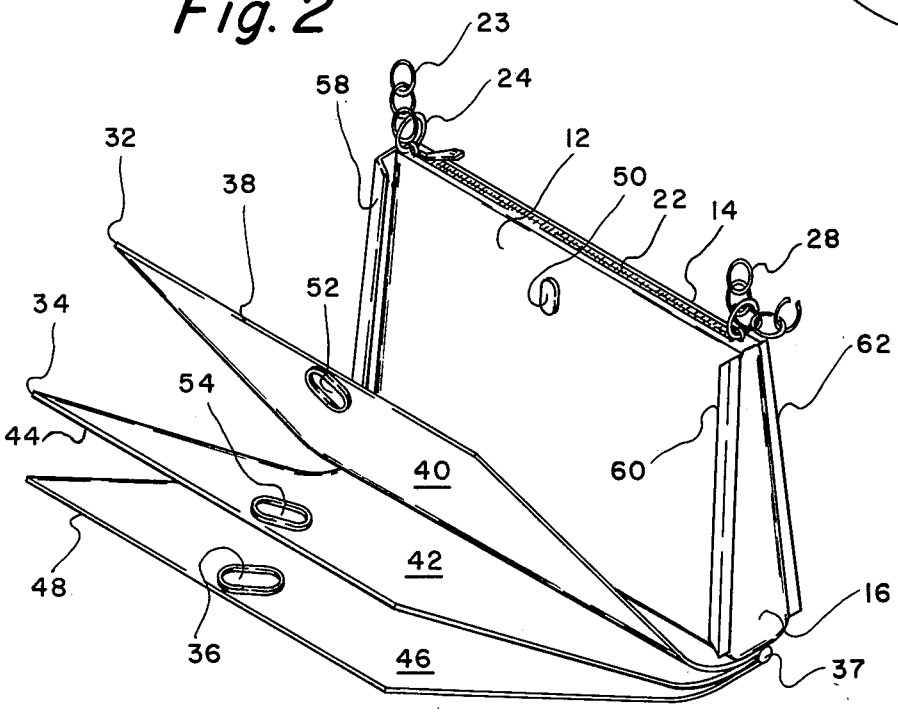
FIG. 2 is a view similar to FIG. 1 showing further details of the construction of the present invention.

As shown in FIG. 2, each facing member has two major surfaces. Facing member 32 includes surfaces 38 and 40, facing member 34 has surfaces 42 and 44 facing member 36 has surfaces 46 and 48. The two major surfaces on each of the facing members are of a different color. However, surfaces which face each other, such as surfaces 40 and 42, are of the same color. For example, the vertical side walls and major surfaces of the facing members may be colored as follows: side wall 12 and surface 38 red; surfaces 40 and 42 black; surfaces 44 and 46 navy blue; and surface 48 and side wall 14 white. Thus, it can be seen that when all of the facing members are covering side wall 12, the bag is white since only side wall 14 and surface 48 are visible. If facing member 36 is rotated counterclockwise, as viewed in FIG. 3, so as to cover side wall 14, the bag would appear to be blue since only surfaces 44 and 46 would be visible. In a like manner, the bag can be made black or red. It should be readily apparent that the foregoing colors are by way of example only and that various other colors could also be employed. Furthermore, in addition to or in the alternative to changing the colors the various surfaces could have different textures, such as alligator, rawhide or patent leather, which could also be changeable when desired.

In order to maintain the several facing members in proper position when they have been moved from one side of the bag 10 to the other, each side wall 12 and 14 is provided with a clasp member 50 and 51, respectively, adjacent the top thereof. The clasp members 50 and 51 are adapted to cooperate with complimentary clasp members on the upper free ends of the facing members. These complimentary clasp members are comprised of holes 52, 54 and 56 located in the upper free end of the facing members 32, 34 and 36, respectively. The clasp members 50-56 are in themselves conventional and accordingly will not be described in further detail. Their manner of use should be readily apparent from FIGS. 1 and 2.

To further enhance the appearance of the handbag 10, a plurality of preferably metallic vertically extending channel members are positioned along the side edges of each of the side walls. As shown best in FIGS. 1 and 2 channel members 58 and 60 are located along the side edges of the first side wall 12 and similar channel members are located along the side edges of the second side wall 14, only one of which, 62, being visible in the figures. The channel members open inwardly toward each other and are adapted to cover the side edges of the facing members 32, 34 and 36 when they are in their proper position. Since the facing members are preferably made from a thin cardboard, or the like, they can be slightly flexed so as to position their side edges into the channel members. Thus, it can be seen that the channel members function to hide the side edges of the facing members so as to enhance the appearance of the handbag 10.

The handbag of the present invention has been described in respect to a particular embodiment thereof set forth in the specification and shown in the drawing. Other modifications and variations in the invention will now become apparent to those skilled in the art. Accordingly, it is to be understood that the detailed description thereof in respect to the particular embodiment is illustrative only and the scope of the invention is to be determined from the claims set forth below.

I claim:

1. A handbag comprising a main body portion in the form of a bag, said main body portion including first and second substantially vertical side walls, first and second substantially vertical end walls and a bottom wall; at least one facing member, said facing member having one end secured to said bottom wall and being moveable between a first position wherein said facing member covers said first side wall and a second position wherein said facing member covers said second side wall, said facing member being of a size such that it covers only one of said side walls at a time and means for selectively securing said facing member to either one of said first and second side walls.

2. A handbag as claimed in claim 1 wherein a plurality of facing members are secured to said bottom wall, all said facing members being of substantially the same size.

3. A handbag as claimed in claim 1 wherein said means for selectively securing includes a clasp member on each of said side walls adjacent the top thereof and a complimentary clasp member on said facing member adjacent the free end thereof.

4. A handbag as claimed in claim 1 further including a substantially vertically extending channel member secured to each vertically extending edge of each of said sides, the side edges of said facing member being adapted to be fitted into said channel members.

5. A handbag as claimed in claim 1 wherein said facing member and said side walls are colored such that when said facing member is covering one of said side walls, a first color is displayed on both sides of said handbag and when said facing member is covering the other of said side walls, a second color is displayed on both sides of said handbag.

* * * * *